US012509859B2

(12) United States Patent
Sulzer

(10) Patent No.: US 12,509,859 B2
(45) Date of Patent: Dec. 30, 2025

(54) TERRAIN MEASUREMENT FOR AUTOMATION CONTROL AND PRODUCTIVITY TRACKING OF WORK MACHINE

(71) Applicant: Deere & Company, Moline, IL (US)

(72) Inventor: Bryan D. Sulzer, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 469 days.

(21) Appl. No.: 18/159,775

(22) Filed: Jan. 26, 2023

(65) Prior Publication Data

US 2024/0254731 A1 Aug. 1, 2024

(51) Int. Cl.

| | |
|---|---|
| ***B64C 19/02*** | (2006.01) |
| ***B64C 27/00*** | (2006.01) |
| ***B64C 27/57*** | (2006.01) |
| ***E02F 9/26*** | (2006.01) |

(52) U.S. Cl.
CPC ..... *E02F 9/262* (2013.01)

(58) Field of Classification Search
CPC ..... E02F 9/262; E02F 3/435; E02F 9/267
See application file for complete search history.

(56) References Cited

U.S. PATENT DOCUMENTS 8,405,721 B2 * 3/2013 Bilandi ..... H04N 7/183 348/143
8,571,762 B2 * 10/2013 McAree ..... E02F 3/46 701/50
8,843,279 B2 * 9/2014 Tafazoli Bilandi ..... E02F 9/264 701/50
10,329,740 B2 * 6/2019 Hokkanen ..... G01S 13/86
10,443,214 B2 * 10/2019 Shimano ..... E02F 9/2296
10,479,354 B2 * 11/2019 Posselius ..... B60W 30/09
10,689,830 B2 * 6/2020 Hageman ..... E02F 9/26
10,712,155 B2 * 7/2020 Howell ..... G01S 17/08
10,733,752 B2 * 8/2020 Hageman ..... G01F 22/00
11,193,246 B2 * 12/2021 Schlenker ..... B60G 3/01
(Continued)

FOREIGN PATENT DOCUMENTS

EP 3351963 A1 7/2018

OTHER PUBLICATIONS

German Search Report issued in application No. 102023136249.6 dated Jul. 29, 2024, 10 pages.

*Primary Examiner* — Mussa A Shaawat

(57) ABSTRACT

A work machine configured to operate on the ground comprises a body, an operating apparatus, a point measuring assembly, a kinematic position sensing assembly, and a controller. The operating apparatus is moveably coupled to the body and has a tool selectively engaging or passing over the ground. The point measuring assembly is coupled to the operating apparatus, is moved together with the operating apparatus and measure distances. The kinematic position sensing assembly is coupled to at least one of the operating apparatus and the body of the work machine, measures positions of the operating apparatus, and transmits signals indicative of the positions of the operating apparatus. The controller receives the signals indicative of the distances from the point measuring assembly and the signals indicative of the positions of the operating apparatus from the kinematic position sensing assembly to calculate at least one simulated surface.

21 Claims, 14 Drawing Sheets

(56) References Cited

U.S. PATENT DOCUMENTS 11,193,255 B2 * 12/2021 Holl ..... E02F 9/262
11,532,184 B2 * 12/2022 Wisley ..... G07C 5/0808
11,591,776 B2 * 2/2023 Hageman ..... E02F 3/961
11,702,819 B2 * 7/2023 Vanderlinde ..... E02F 9/265 701/50
11,788,254 B2 * 10/2023 Aizawa ..... E02F 9/2296 701/50
11,795,658 B2 * 10/2023 Aizawa ..... E02F 3/435
11,805,721 B2 * 11/2023 Sporrer ..... A01B 79/005
11,808,007 B2 * 11/2023 Hageman ..... E02F 9/265
11,966,220 B2 * 4/2024 Kean ..... G05D 1/227
12,071,746 B2 * 8/2024 Spendlove ..... E02F 9/2004
2004/0093142 A1 * 5/2004 Nelson ..... E02F 3/435 701/50
2007/0214687 A1 9/2007 Woon et al.
2008/0005938 A1 * 1/2008 Aebischer ..... E02F 9/264 73/32 R
2009/0112472 A1 * 4/2009 Montgomery ..... G01S 17/06 701/514
2010/0052684 A1 * 3/2010 Fling ..... G01V 3/15 324/326
2013/0293408 A1 * 11/2013 Underwood ..... G01S 13/89 342/146
2016/0104289 A1 * 4/2016 Chang ..... G06T 7/33 382/154
2016/0154094 A1 * 6/2016 Ishimaru ..... G01S 17/42 356/4.01
2016/0312446 A1 10/2016 Pettersson et al.
2017/0002546 A1 * 1/2017 Fletcher ..... E02F 3/431
2018/0251961 A1 9/2018 France et al.
2018/0355586 A1 * 12/2018 Ohiwa ..... E02F 3/435
2020/0325653 A1 * 10/2020 Hageman ..... E02F 9/265
2021/0002871 A1 * 1/2021 Yamanaka ..... E02F 3/32
2021/0017738 A1 * 1/2021 Sano ..... E02F 9/261
2021/0032850 A1 * 2/2021 Holl ..... E02F 3/847
2021/0363726 A1 * 11/2021 Aizawa ..... E02F 9/2041
2021/0372086 A1 * 12/2021 Aizawa ..... E02F 9/262
2022/0002973 A1 * 1/2022 Pawar ..... E02F 3/4135
2022/0042278 A1 * 2/2022 Currier ..... G05D 1/0289
2022/0049477 A1 * 2/2022 Yamanaka ..... G06F 18/214
2022/0106767 A1 * 4/2022 Viergutz ..... E02F 9/2033
2022/0106769 A1 * 4/2022 Takaoka ..... E02F 3/841
2022/0130063 A1 4/2022 Thomas et al.
2023/0003893 A1 1/2023 He et al.
2023/0133175 A1 * 5/2023 Czarnecki ..... G06T 7/11 701/301
2024/0060262 A1 * 2/2024 Jancek ..... E02D 3/026

* cited by examiner

TERRAIN MEASUREMENT FOR AUTOMATION CONTROL AND PRODUCTIVITY TRACKING OF WORK MACHINE

CROSS-REFERENCE TO RELATED APPLICATIONS

N/A.

TECHNICAL FIELD

The present disclosure relates generally to a work machine configured to measure the terrain of the ground to track the productivity of the work machine.

BACKGROUND

Several work machines, including agricultural work machine and construction work machine, need to engage with the ground. For one example, an excavator may shovel and collect materials from the ground or deposit materials to the ground. The terrain changes of the ground may need to be recorded.

LiDAR scanners are used by transportation vehicles such as airplane. The internal components of LiDAR scanners are configured to change the direction of the laser beam from the LiDAR scanners so as scan a wide area for topography. However, due to the environment of the work machines and the cost of the LiDAR scanners, the LiDAR scanner may not be an ideal sensor to record the terrain changes of the ground.

SUMMARY

According to an aspect of the present disclosure, a work machine configured to operate on the ground, comprises a body, an operating apparatus, a point measuring assembly, a kinematic position sensing assembly, and a controller. The operating apparatus is moveably coupled to the body and has a tool selectively engaging or passing over the ground. The point measuring assembly is coupled to the operating apparatus and is moved together with the operating apparatus. The point measuring assembly is configured to measure distances, each of which is between the point measuring assembly and one of range finding points designated on the ground by the point measuring assembly. The point measuring assembly is configured to transmit signals indicative of the distances. The distributions of the range finding points are in response to a motion of the operating apparatus. The kinematic position sensing assembly is coupled to at least one of the operating apparatus and the body of the work machine. The kinematic position sensing assembly is configured to measure positions of the operating apparatus and to transmit signals indicative of the positions of the operating apparatus. The controller is configured to receive the signals indicative of the distances from the point measuring assembly and the signals indicative of the positions of the operating apparatus from the kinematic position sensing assembly. The controller is configured to calculate at least one simulated surface of the ground based on the signals indicative of the distances and the signals indicative of the positions of the operating apparatus.

According to an aspect of the present disclosure, a method of measuring terrain by a work machine configured to operate on the ground, the method comprising: moving an operating apparatus moveably coupled to a body of the work machine and having a tool selectively engaging or passing over the ground; measuring distances via a point measuring assembly coupled to the operating apparatus and moved together with the operating apparatus, wherein each of the distances is between the point measuring assembly and one of range finding points designated on the ground by the point measuring assembly, and distributions of the range finding points are in response to a motion of the operating apparatus; transmitting signals indicative of the distances from the point measuring assembly; measuring positions of the operating apparatus by a kinematic position sensing assembly coupled to at least one of the operating apparatus and the body of the work machine; transmitting signals indicative of the positions of the operating apparatus; receiving the signals indicative of the distances from the point measuring assembly and the signals indicative of the positions of the operating apparatus from the kinematic position sensing assembly by a controller to calculate at least one simulated surface of the ground based on the signals indicative of the distances and the signals indicative of the positions of the operating apparatus.

Other features and aspects will become apparent by consideration of the detailed description, claims, and accompanying drawings.

BRIEF DESCRIPTION OF THE DRAWINGS

The detailed description of the drawings refers to the accompanying figures.

Like reference numerals are used to indicate like elements throughout the several figures.

DETAILED DESCRIPTION

Advanced three-dimensional object sensors, such as light detection and ranging (LiDAR) sensors, may emit laser to sweeps across the surface of a particular object and create 3-D models. Those sensors may be fixed on a specific location of a machinery, such as drone, car, for detecting the environment. However, those sensors may be uneconomical or unpractical to installed to every work machine. The present disclosure describes a work machine performs terrain measurement for automation control and productivity tracking through a kinematic position sensing assembly and a point measuring assembly, which will be described below.

Figure 1:
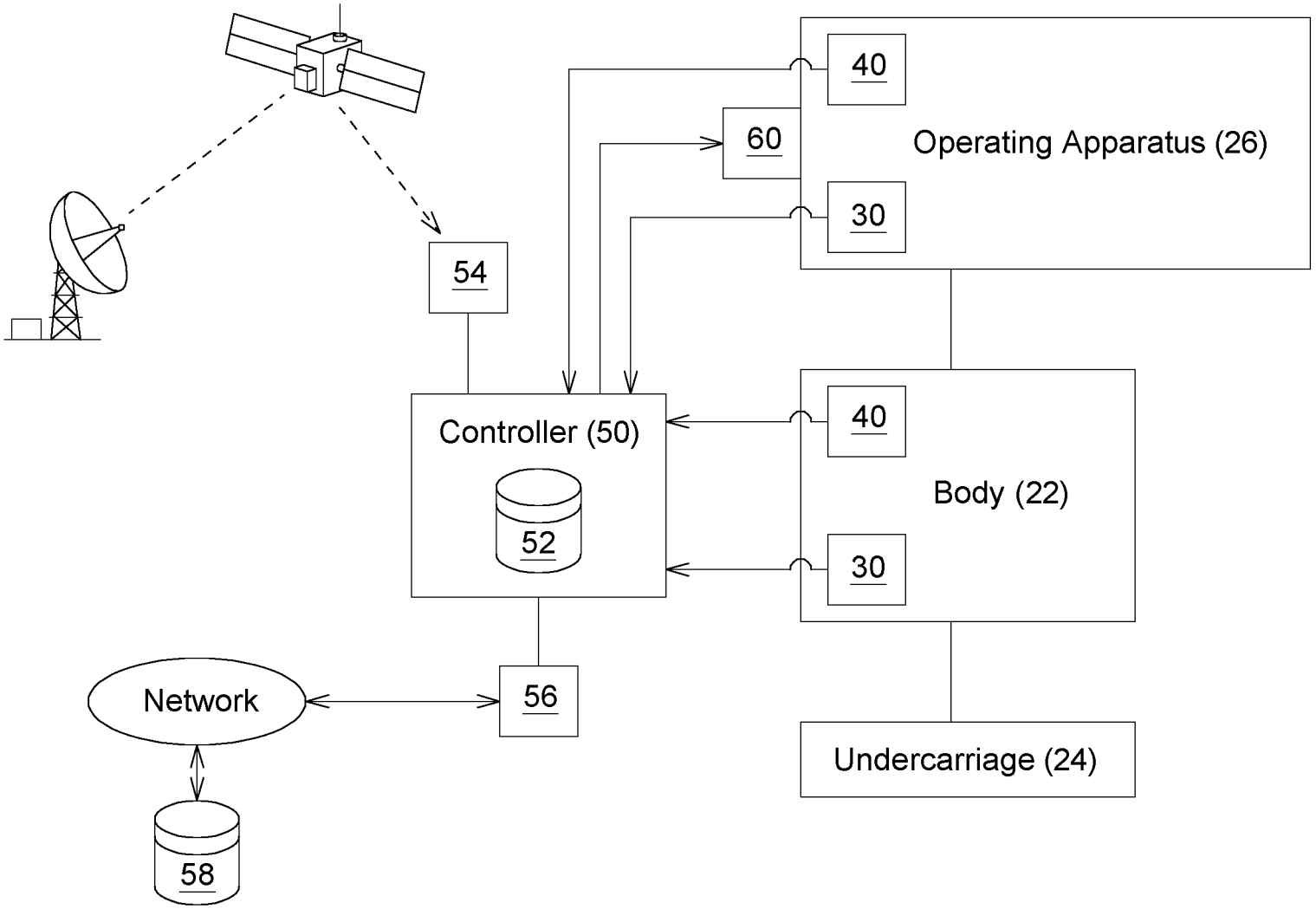
FIG. 1 demonstrate a block diagram illustrates a general structure of a system configured for terrain measurement, productivity tracking, and automation control.

Referring to FIG. 1, a system is configured for terrain measurement and productivity tracking for a work machine 20. The work machine 20 may be embodied as an excavator (as one explanatory implementation shown in FIG. 2A), a dozer, a backhoe loader, etc., operates on the ground. The work machine 20 may include a body 22, undercarriage 24, an operating apparatus 26, a kinematic position sensing assembly 30, a point measuring assembly 40, and a controller 50. FIG. 1 provides general structure of the system operable for terrain measurement and/or productivity tracking for the work machine 20. Specific examples, such as the types of work machine 20, components of operating apparatus 26, the types, the number, and the allocation of the kinematic position sensing assembly 30, the types, the number, and the allocation of the point measuring assembly 40, and the operation that the work machine 20 measure the distance(s) and calculates a simulated surface of the ground, etc., will be described later with FIGS. 2A-7.

The body 22 may include a frame, where powertrain like engine, transmission, and hydraulic pump may be enclosed, and a cab coupled to the frame. The undercarriage 24 supports the body 22. As one of the examples, shown in FIG. 2A, the body 22 is pivotally mounted on the undercarriage 24 by means of a swing pivot (not shown). The undercarriage 24 may include a ground-engaging tracks or wheels for moving along the ground. The operating apparatus 26 is moveably coupled to the body 22 and has one or more moving components (e.g., a boom 262 and an arm 264) and a tool (e.g., a bucket 266 pivotally coupled to a distal end of the arm 264) selectively engaging the ground.

The kinematic position sensing assembly 30, which may include one or more kinematic position sensors, is coupled to at least one of the operating apparatus 26 and the body 22 of the work machine 20. Some of the kinematic position sensing assembly 30 may include angle sensor(s) measuring the angle(s) between the moving components of the operating apparatus 26 (like the angle $\theta_1$ between the boom 262 and arm 264 in FIG. 2A) and/or the angle between one of the moving components and the body 22 (like the angle $\theta_3$ between the boom 262 and the body 22 in FIG. 2A). Another angle sensor (i.e., a fourth kinematic position sensor 34) may be used to detect the rotational angle of the body 22 relative to the undercarriage 24 (like the body 22/upper frame's offset angle relative to the undercarriage 24). Alternatively or additionally, some of the kinematic position sensing assembly 30 may include position sensor(s) that measures the displacement of an actuator assembly 60 that moves the moving component(s) of the operating apparatus 26 (like hydraulic cylinders that pivot the boom 262 relative to the body 22, pivot the arm 264 relative to the boom 262, and/or pivot the bucket 266 relative to the arm 264) or rotates the body 22 relative to the undercarriage 24. The kinematic position sensing assembly 30 may also include a slope sensor (i.e., a fifth kinematic position sensor 35) to measure a slope of a location at which the work machine 20 is located. The slope sensor may be a level sensor measure the slope of the location relative to the gravity. The kinematic position sensing assembly 30, through multiple kinematic position sensors thereof, is configured to measure one or more kinematic parameters to directly or indirectly measure the positions of the operating apparatus 26 and to transmit signals indicative of the positions of the operating apparatus 26 to the controller 50.

The point measuring assembly 40 is coupled to the operating apparatus 26 and is moved together with the operating apparatus 26. The point measuring assembly 40 may include one or more sensors, which is described later. The point measuring assembly 40 is configured to measure distances, each of which is between the point measuring assembly 40 and one of range finding points designated on the ground by the point measuring assembly 40. The point measuring assembly 40, for example, may include a range finding laser/light sensor(s), an ultrasonic sensor(s), and a radar(s). The range finding laser/light sensor(s) may emit laser/light to the ground, receive the reflection therefrom, and covert the reflection into an electrical signal. The ultrasonic sensor(s) may emit the ultrasonic sound waves to the ground, receive the reflection therefrom, and convert the reflection into an electrical signal. The radar(s) may emit the electromagnetic radiation waves to the ground, receive the reflection therefrom, and convert the reflection into an electrical signal. The point measuring assembly 40 is configured to transmit signals indicative of the distances to the controller 50, based on the time delay between the emission and the reflection of laser/light, ultrasonic sound waves, or electromagnetic radiation waves. The distributions of the range finding points RFP (such as $RFP_1$, $RFP_2$, $RFP_3$ shown in FIGS. 2C-4C) are in response to the motion of the operating apparatus 26, such as the boom 262 or the arm 264, attached by the point measuring assembly 40, moving above the ground. The proximal end of the boom 262 is pivotally coupled to the body 22 and a proximal end of the arm 264 is pivotally coupled to the distal end of the boom 262. The arm 264 is swingable above the ground. More structural details will be embodied the drawings like FIGS. 2A-5B.

The controller 50 is disposed in communication with the kinematic position sensing assembly 30, the point measuring assembly 40, and the actuator assembly 60. The controller 50 is operable to receive the signals indicative of the distances between the point measuring assembly 40 and the range finding points RFP from the point measuring assembly 40 and the signals indicative of the positions of the operating apparatus 26 from the kinematic position sensing assembly 30 and to communicate signals to the actuator assembly 60. While the controller 50 is generally described herein as a singular device, it should be appreciated that the controller 50 may include multiple devices linked together to share and/or communicate information therebetween. Furthermore, it should be appreciated that the controller 50 may be located on the work machine 20 or located remotely from the work machine 20.

The controller 50 may alternatively be referred to as a computing device, a computer, a control unit, a control module, a module, etc. The controller 50 includes a processor, a memory (e.g., the memory 52 shown in FIG. 1), and all software, hardware, algorithms, connections, sensors, etc., necessary to manage and control the operation of the kinematic position sensing assembly 30, the point measuring assembly 40, and the actuator assembly 60. As such, a method may be embodied as a program or algorithm operable on the controller 50. It should be appreciated that the controller 50 may include any device capable of analyzing data from various sensors, comparing data, making decisions, and executing the required tasks.

As used herein, "controller 50" is intended to be used consistent with how the term is used by a person of skill in the art, and refers to a computing component with processing, memory, and communication capabilities, which is utilized to execute instructions (i.e., stored on the memory or received via the communication capabilities) to control or communicate with one or more other components. In certain embodiments, the controller 50 may be configured to receive input signals in various formats (e.g., hydraulic signals, voltage signals, current signals, CAN messages, optical signals, radio signals), and to output command or communication signals in various formats (e.g., hydraulic signals, voltage signals, current signals, CAN messages, optical signals, radio signals).

The controller 50 may be in communication with other components on the work machine 20, such as hydraulic components, electrical components, and operator inputs within an operator station of an associated work machine. The controller 50 may be electrically connected to these other components by a wiring harness such that messages, commands, and electrical power may be transmitted between the controller 50 and the other components. Although the controller 50 is referenced in the singular, in alternative embodiments the configuration and functionality described herein can be split across multiple devices using techniques known to a person of ordinary skill in the art.

The controller 50 may be embodied as one or multiple digital computers or host machines each having one or more processors, read only memory (ROM), random access memory (RAM), electrically-programmable read only memory (EPROM), optical drives, magnetic drives, etc., a high-speed clock, analog-to-digital (A/D) circuitry, digital-to-analog (D/A) circuitry, and any required input/output (I/O) circuitry, I/O devices, and communication interfaces, as well as signal conditioning and buffer electronics.

The computer-readable memory may include any non-transitory/tangible medium which participates in providing data or computer-readable instructions. The memory may be non-volatile or volatile. Non-volatile media may include, for example, optical or magnetic disks and other persistent memory. Example volatile media may include dynamic random access memory (DRAM), which may constitute a main memory. Other examples of embodiments for memory include a floppy, flexible disk, or hard disk, magnetic tape or other magnetic medium, a CD-ROM, DVD, and/or any other optical medium, as well as other possible memory devices such as flash memory.

The controller 50 includes the tangible, non-transitory memory on which are recorded computer-executable instructions, including a surface simulation algorithm, a productivity tracking algorithm, and an automation control algorithm. The processor(s) of the controller is configured for executing the surface simulation algorithm, the productivity tracking algorithm, and an automation control algorithm. The surface simulation algorithm implements a method of calculating at least one simulated surface of the ground, including a non-operated simulated surface NSS (an example shown in FIG. 2D) and/or an operated simulated surface OSS (an example shown in FIG. 2E). The controller 50 calculates the non-operated simulated surface NSS or the operated simulated surface OSS of the ground by aggregating sub-areas in three-dimensional space, and each of the sub-areas is defined by at least two of the range finding points RFP designated on the ground by the point measuring assembly 40. The non-operated simulated surface NSS of the ground is a simulated surface of the ground, which is not currently engaged by the tool. In one implementation, the non-operated simulated surface NSS may be a simulated surface of the ground before the tool engages the ground during an action of the operating apparatus for relocating the material of the ground. The operated simulated surface OSS (examples as shown in FIG. 2E) of the ground is a simulated surface of the ground after the tool engages the ground. It is noted that the non-operated simulated surface may also include previous operated simulated surface of the ground that had been changed due to previous/earlier action(s) of the operating apparatus for relocating the material of or to the ground (e.g., removing or dumping the material). The productivity tracking algorithm implements a method of tracking the productivity of the operation of the work machine 20 based on a volume between the non-operated simulated surface and the operated simulated surface in three dimensions. The automation control algorithm implements a method of automation control to optimize the operation to increase the productivity. The method of simulated surface calculation and the method of tracking the productivity will be described in detail later. It is noted that the non-operated simulated surface NSS, which is not currently engaged by the tool, may be a simulated surface of the ground calculated by the controller 50 when the tool passes over the ground for the terrain measurement.

It is noted that, optionally, the controller 50 may be in communication with a location sensor 54 of the work machine 20. The location sensor 54 may generate a signal indicative of the present location of the work machine 20. The location sensor 54 may be a component of the satellite positioning systems (SATPSs), such as the Global Positioning System (GPS) and other global navigation satellite systems (GNSSs), to identify the location (e.g., latitude and longitude) of the work machine 20 on the SATPSs' coordinates. The location sensor 54, in one implementation, is a receiver in the Global Navigation Satellite Systems (GNSS) and configured to identify the location of the work machine 20. The controller 50 may utilize the location of the work machine 20 to find the slope of location at which the work machine 20 is located through the topographical data saved in the memory 52. In another implementation, the topographical data may be saved a memory 58 (database) connected to the network, and the controller 50 is coupled to a transceiver 56 in communication with the network to download the topographical data.

Figure 2A:
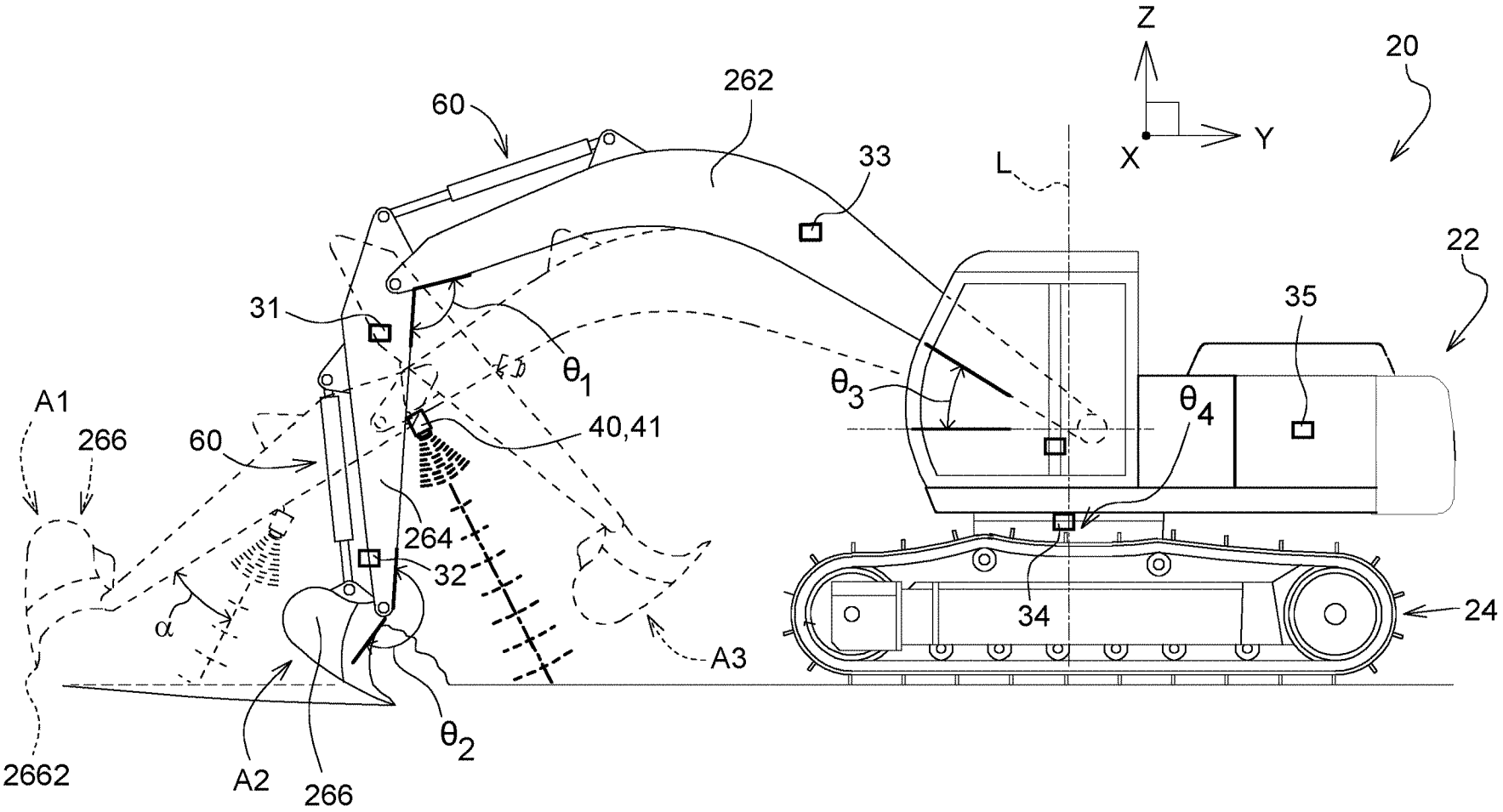
FIG. 2A demonstrates one example of a work machine, which is an excavator, measuring distances, each of which is between one sensor (first sensor) of a point measuring assembly attached on an arm and one of range finding points designated on the ground when the sensor is moved with the arm.
Figure 2B:
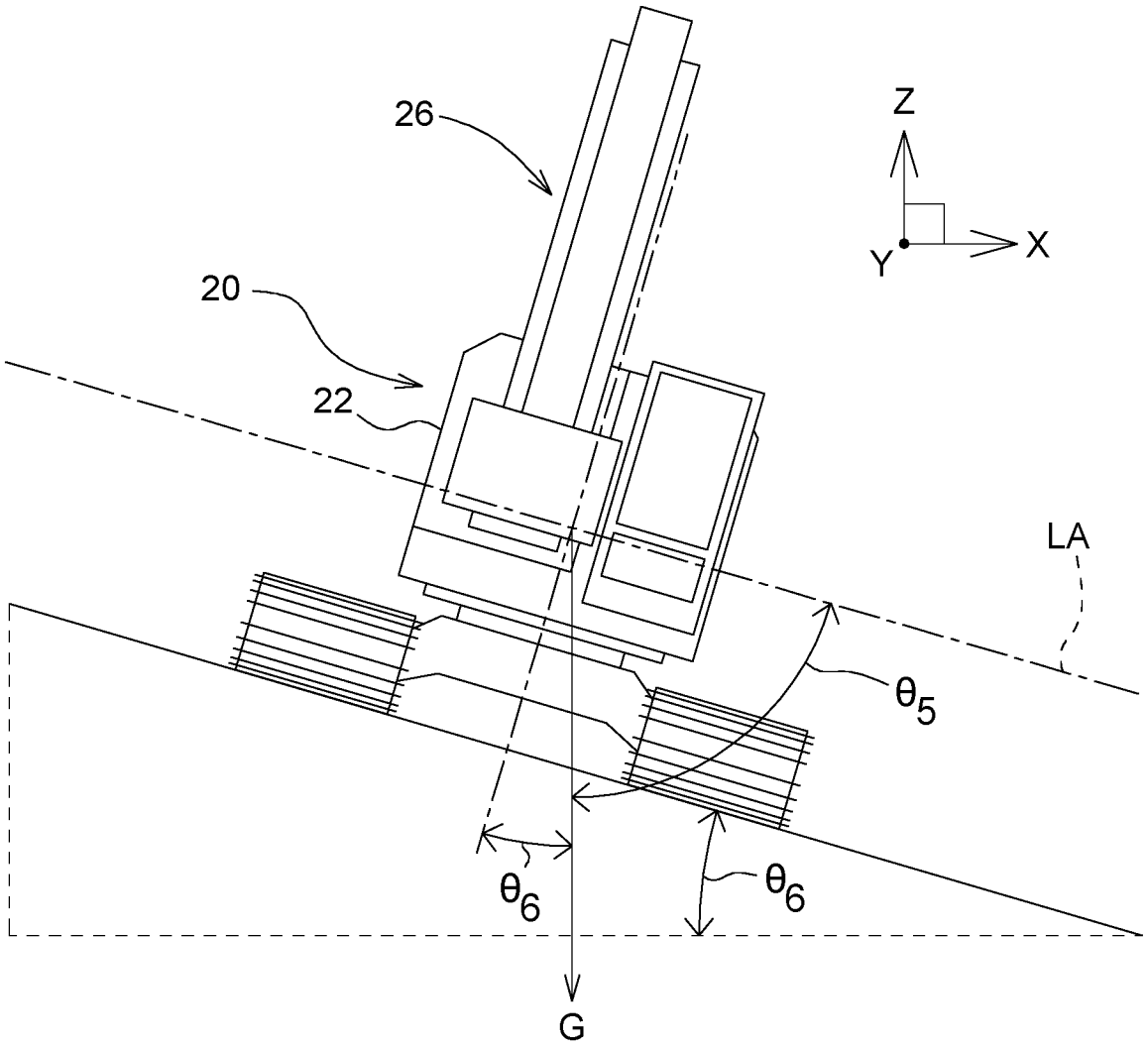
FIG. 2B demonstrates the work machine of FIG. 2A, positioned on the ground.
Figure 2C:
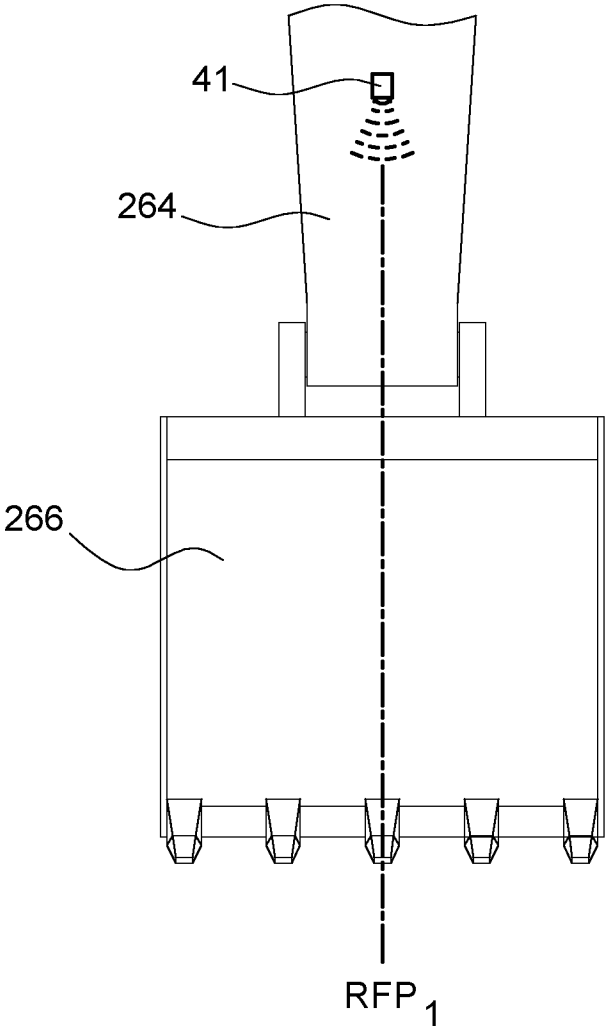
FIG. 2C is a partial rear view illustrating a first sensor attached on the arm of the work machine.
Figure 2D:
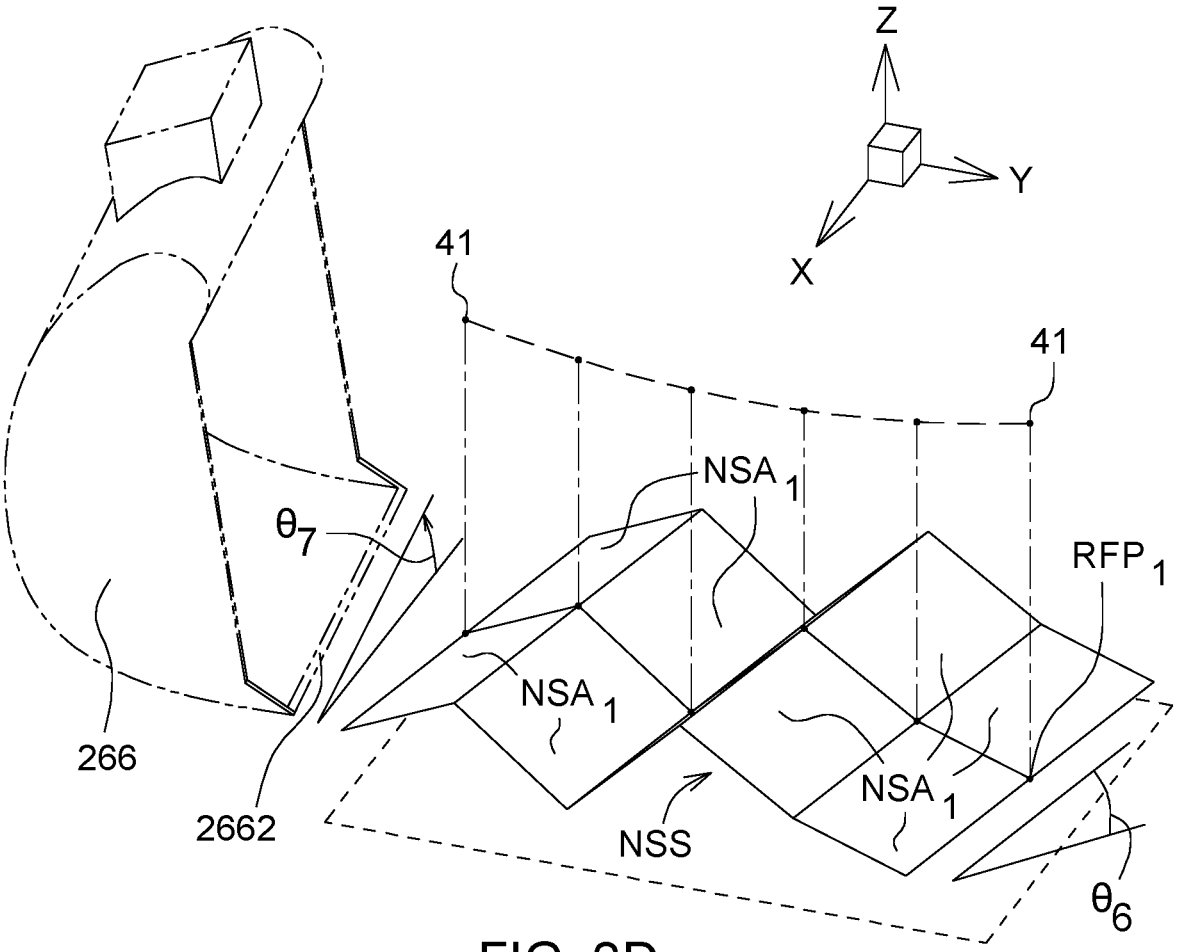
FIG. 2D illustrates the first sensor's trajectory with the motion of the operating apparatus that moves from the position A1 to the position A2 and then to the position A3, and a non-operated simulated surface of the ground having sub-areas before the tool engages the ground.
Figure 2E:
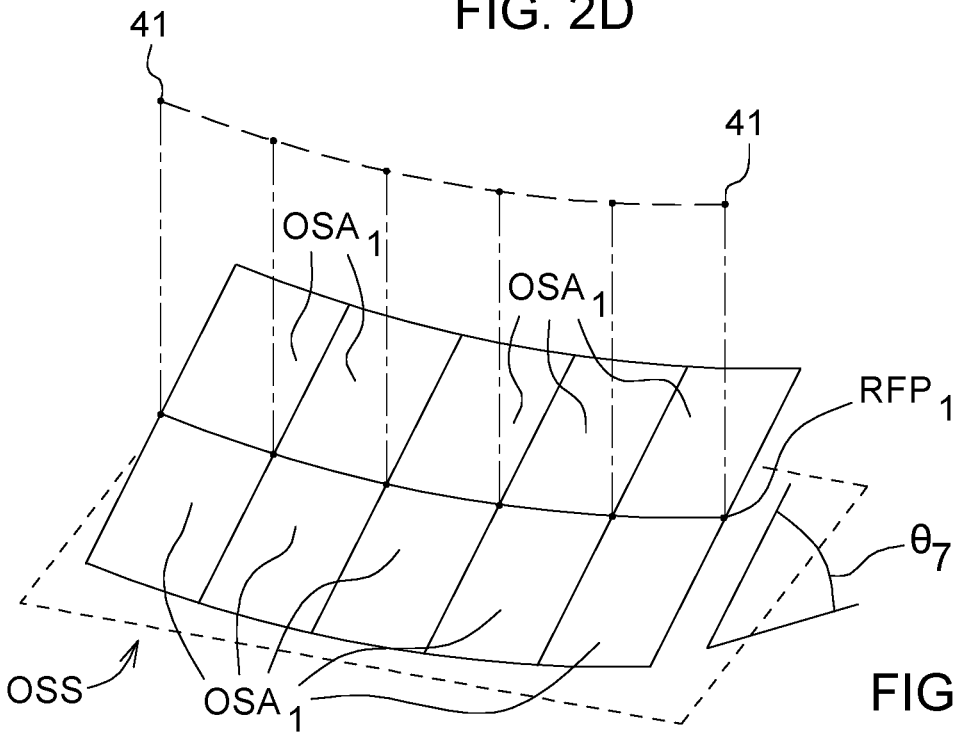
FIG. 2E illustrates the first sensor's trajectory with the motion of the operating apparatus that moves from the position A3 to the position A2 and then to the position A1, and an operated simulated surface of the ground having sub-areas after the tool engages the ground.

Referring to FIGS. 2A-2E, the work machine 20 is positioned on the ground to measure the terrain of the ground with the point measuring assembly 40. As shown in FIG. 2A, the kinematic position sensing assembly 30 in this example includes a first kinematic position sensor 31 coupled to the arm 264 to measure the kinematic position of the arm 264, a second kinematic position sensor 32 coupled to the arm 264 adjacent to the bucket 266 to measure the kinematic position of the bucket 266, a third kinematic position sensor 33 coupled to the boom to measure the kinematic position of the boom 262, a fourth kinematic position sensor 34 coupled to the body 22 of the work machine 20 to measure the kinematic position of the body 22 relative to the undercarriage 24, and the fifth kinematic position sensor 35 configured to measure the slope of the location. The controller 50, as discussed previously, is disposed in communication with the kinematic position sensing assembly 30 (e.g., the first kinematic position sensor 31, the second kinematic position sensor 32, the third kinematic position sensor 33, the fourth kinematic position sensor 34, and the fifth kinematic position sensor 35) to receive the signals indicative of the kinematic positions of the arm 264, the bucket 266, the boom 262, the body 22. In this implementation, the point measuring assembly 40 includes a first sensor 41 coupled to the arm 264 of the operating apparatus 26. As shown in FIG. 2C, the first sensor 41 is attached on an inward side of the arm 264. The first sensor 41 is moved together with arm 264 of the operating apparatus 26 and configured to measure distances, each of which, as shown in FIGS. 2D and 2E, is between the first sensor 41 and one of the first range finding points $RFP_1$ designated on the ground by the first sensor 41.

FIG. 2A illustrates three explanatory positions A1-A3 of the operating apparatus 26. An angle $\Theta_1$ is between the arm 264 and the boom 262; an angle $\Theta_2$ is between the arm 264 and the bucket 266, an angle $\Theta_3$ is between the boom 262 and the body 22, an angle $\Theta_4$ is a swing angle that the body 22 swings relative to the undercarriage 24 about an axis L, and an angle $\Theta_5$ is between an axis (in the example shown in FIG. 2B, the axis is a lateral axis LA across two opposite sides of the body 22) and the gravity G. The angle $\Theta_5$ measured by the fifth kinematic position sensor 35. It is noted that the angle $\Theta_6$ of the location is a complementary angle of the angle $\Theta_5$ and therefore the fifth kinematic position sensor 35 may indirectly measure the angle $\Theta_6$ (slope) of the location. The direction of the first sensor 61 (i.e., the direction of laser/light, ultrasonic sound waves, or electromagnetic radiation waves that the first sensor 41 emits) and the direction of the extension of the arm 264 form an offset angle $\alpha$, which may allow the first sensor 41 detect the distance between the first sensor 41 and the ground before the bucket 266 engages the ground when the angle $\Theta_1$ is between the arm 264 and the boom 262 decrease. When the operating apparatus 26 moves from the position A1 to the position A3, the first sensor 41 can measure the distance between the first sensor 41 and the ground surface before the bucket 266 engages the ground. When the operating apparatus 26 moves to the position A2, where the angle $\Theta_1$ between the arm 264 and the boom 262 decreases and the angle $\Theta_3$ between the boom 262 and the body 22 increases, for example, the first sensor 41 had completed distance measurements of the ground during the movement of operating apparatus 26 from the position A1 to the position A2. FIG. 2C is a partial rear view illustrating an explanatory position of the first sensor 41 attached on the arm 264 of the work machine 20.

FIG. 2D illustrates the first sensor's 41 trajectory with the motion of the operating apparatus 26 that moves from the position A1 to the position A2 and then to the position A3 (shown in FIG. 2A), and a non-operated simulated surface NSS of the ground having sub-areas $NSA_1$ before the bucket 266 engages the ground. Multiple distances between the first sensor 41 at different locations in the trajectory and respective first range finding points $RFP_1$ designated on the ground by the first sensor 41 are measured before the bucket 266 engages the ground. The sub-areas $NSA_1$ are defined by at least two of the first range finding points $RFP_1$ designated on the ground by the first sensor 41 and the slope of the location at which the work machine 20 is located (represented by the angle $\Theta_6$ between a plane passing through the location and a horizontal plane). As discussed, the slope of the location may be determined by the controller 50 based on the signals indicative of the position of the work machine 20 from the fifth kinematic position sensor 35 or based on topographical data saved in the memory 52 (and/or the memory 58/database), after location sensor 54 identify the location of the work machine 20. Each sub-area $NSA_1$ is determined by the controller 50 based on the signals from the first sensor 41 and the slope information as discussed. In this implementation, the sub-areas $NSA_1$ is generally rectangular. The two parallel widths and the direction (the slope of the widths) are determined by two of the adjacent first range finding points $RFP_1$; the amount of the two lengths may be pre-determined and direction of the two length is parallel to the slope of the location at which the work machine 20 is located. The controller 50 calculates the non-operated simulated surface NSS of the ground by aggregating the sub-areas $NSA_1$ in three-dimensional space. It is noted that information regarding the slope(s) of an edge 2662 of the tool determined by the controller 50 during the operating apparatus 26 swinging or moving from the position A1 to the position A3 at least based on signals indicative of the positions of the operating apparatus 26 from the kinematic position sensing assembly 30 and the geometry of the work machine 20. The information of slope(s) of the edge 2662 (represented by an angle $\Theta_7$ between the edge 2662 and the horizontal plane) may be used by the controller 50 to partially defines sub-areas $OSA_1$ of an operated simulated surface OSS, which is discussed in next paragraph. The tool is a bucket 266 having the edge 2662 that shovels the ground.

FIG. 2E illustrates the first sensor's 41 trajectory with the motion of the operating apparatus 26 that moves from the position A3 to the position A2 and then to the position A1, and the operated simulated surface OSS of the ground having sub-areas $OSA_1$ after the bucket 266 engages the ground. Multiple distances between the first sensor 41 at different locations in the trajectory and respective first range finding points RFP1 designated on the ground by the first sensor 41 are measured after the bucket 266 engages the ground. The sub-areas $OSA_1$ may be defined by at least two of the first range finding points $RFP_1$ designated on the ground by the first sensor 41 and the slope(s) of the edge 2662 corresponding to the at least two of the first range finding points $RFP_1$. In this implementation, the sub-areas $OSA_1$ is rectangular. The two parallel widths and the direction (the slope of the widths) are determined by two of the adjacent first range finding points $RFP_1$; the amount of the two lengths may be pre-determined and direction of the two length is parallel to the slope of the edge 2662. The controller 50 calculates the operated simulated surface OSS of the ground by aggregating the sub-areas $OSA_1$ in three-dimensional space.

Figure 2F:
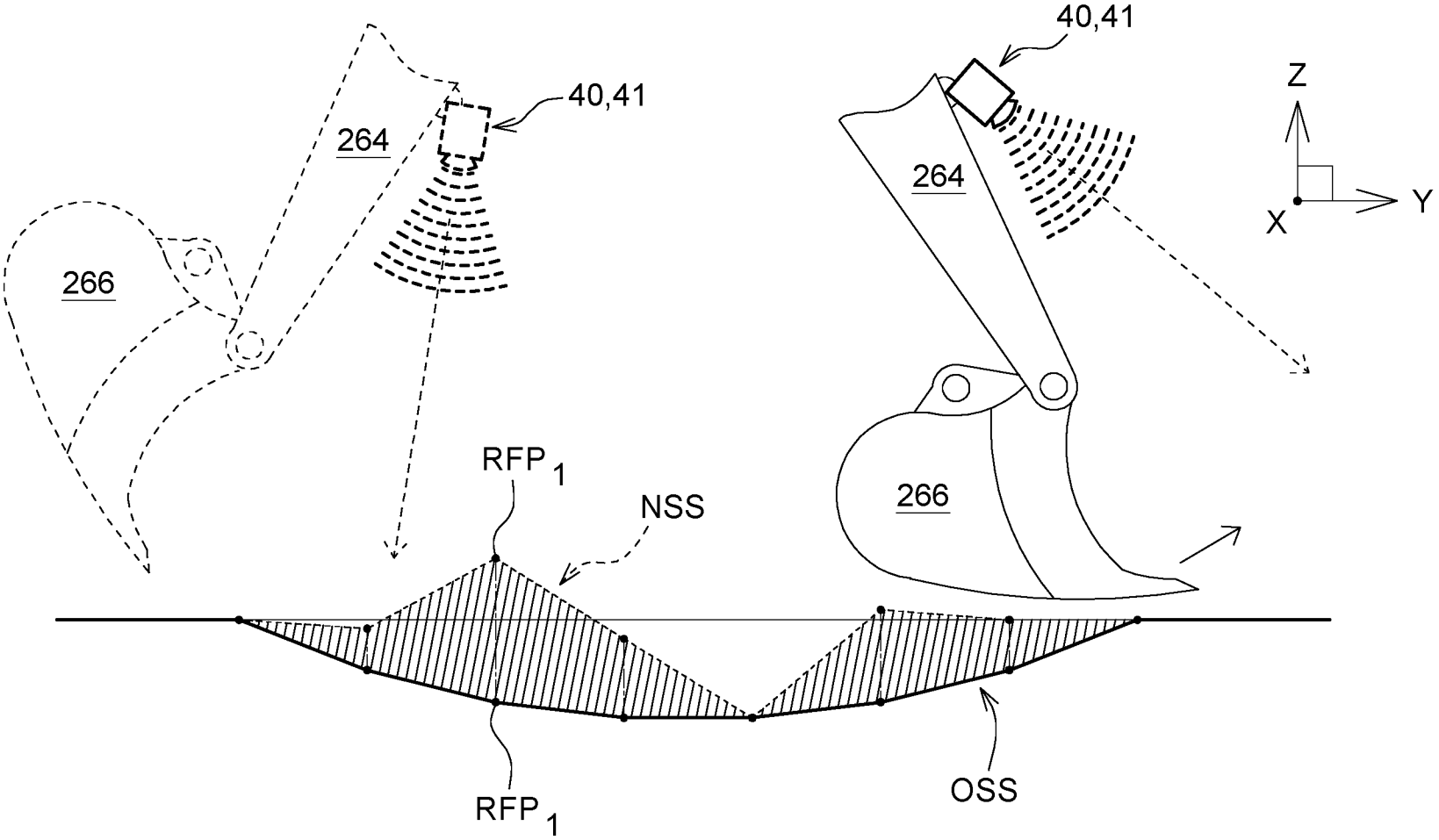
FIG. 2F illustrates a volume defined between the non-operated simulated surface in FIG. 2D and the operated simulated surface in FIG. 2E in three dimensions.

As discussed previously, the controller 50 may calculate the non-operated simulated surface NSS of the ground before the tool (bucket 266) engages the ground and calculate the operated simulated surface OSS of the ground after the tool engages the ground based on the signals indicative of the distances and the signals indicative of the positions of the operating apparatus 26. The controller 50 may also be able to track a productivity of the operating apparatus 26 resulted from relocating the material from the ground based on a volume between the non-operated simulated surface NSS and the operated simulated surface OSS in three dimensions, as shown in FIG. 2F. When the productivity is lower than a pre-stored threshold saved in the memory 52 of the controller 50, the controller 50 may analyze the reason for the low productivity and initiate automation control. For example, the work machine 20 may travel to different locations, swift the body 22 relative to the undercarriage 24, adjust relative positions of the operating apparatus 26 to change the location of the ground that the bucket 266 is going to engage, the angle between the edge 2662 of the bucket 266 and the ground, and/or the driving power, such as hydraulic power, to control the operating apparatus 26 engaging the ground, etc. The automation control may include other means to optimize future operation of the work machine 20.

Figure 3A:
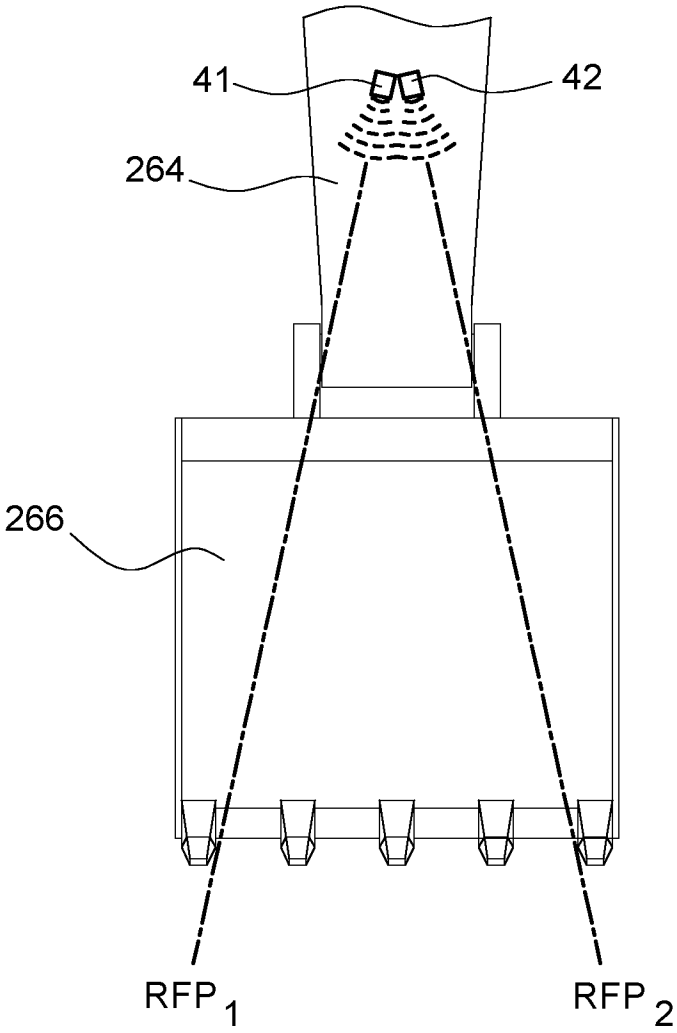
FIG. 3A is a partial rear view illustrating a first sensor and a second sensor attached on the arm of the work machine in another implementation of the point measuring assembly.
Figure 3B:
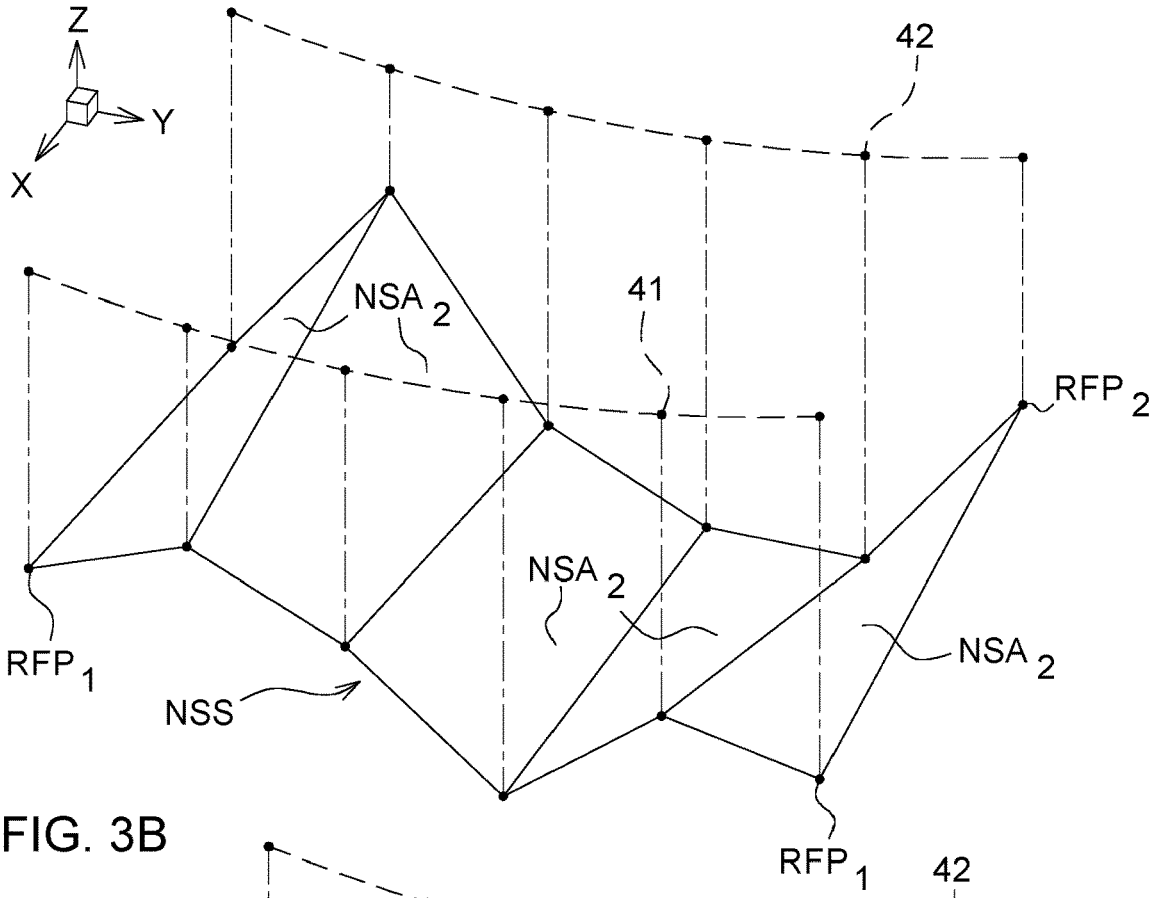
FIG. 3B illustrates the first sensor's trajectory and the second sensor's trajectory with the motion of the operating apparatus and a non-operated simulated surface of the ground having sub-areas before the tool engages the ground.
Figure 3C:
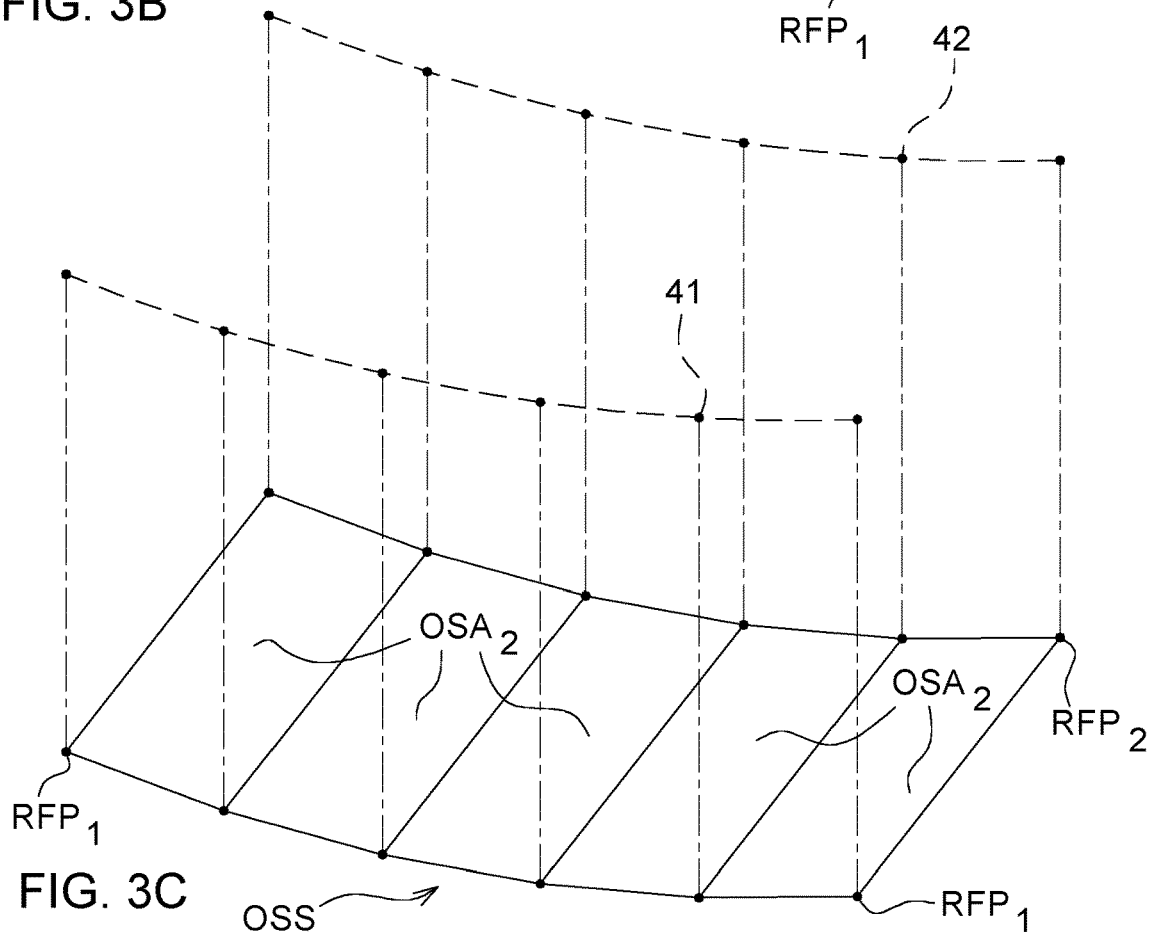
FIG. 3C illustrates the first sensor's trajectory and second sensor's trajectory with the motion of the operating apparatus and an operated simulated surface of the ground having sub-areas after the tool engages the ground.

Referring to FIGS. 3A-3C, another implementation of the point measuring assembly 40 includes a first sensor 41 and a second sensor 42 attached to the inward side of the arm 264 of the operating apparatus 26 and moved together with the arm 264. The first sensor 41 and the second sensor 42 scan a toward area of the ground (e.g., TA in FIG. 6) corresponding to the arm 264 swinging toward the body 22 of the work machine 20. Referring to FIG. 3B, multiple distances between the first sensor 41 at different locations in its trajectory and respective first range finding points $RFP_1$ designated on the ground by the first sensor 41 are measured before the bucket 266 engages the ground. Similarly, multiple distances between the second sensor 42 at different locations in its trajectory and respective second range finding points $RFP_2$ designated on the ground by the second sensor 42 are measured before the bucket 266 engages the ground. Every two adjacent first range finding points $RFP_1$ and every two adjacent second range finding points $RFP_2$ together define a sub-areas $NSA_2$, which is quadrilateral. It is noted that two adjacent first range finding points $RFP_1$ and two adjacent second range finding points $RFP_2$ of each sub-areas $NSA_2$ define the slopes of the four sides of the sub-area $NSA_2$. In this implementation, two sensors (first and second sensors 41, 42) designate range finding points RFP ($RFP_1$ and $RFP_2$) to form a row of sub-areas (sub-areas $NSA_2$) along the trajectories of the first and second sensors 41, 42. The controller 50 calculates the non-operated simulated surface NSS of the ground by aggregating the sub-areas $NSA_2$ in three-dimensional space.

Referring to FIG. 3C, multiple distances between the first sensor 41 at different locations in the trajectory and respective first range finding points $RFP_1$ designated on the ground by the first sensor 41 are measured after the bucket 266 engages the ground. Similarly, multiple distances between the second sensor 42 at different locations in the trajectory and respective second range finding points $RFP_2$ designated on the ground by the second sensor 42 are measured after the bucket 266 engages the ground. Every two adjacent first range finding points $RFP_1$ and every two adjacent second range finding points $RFP_2$ together define a sub-areas $OSA_2$, which is quadrilateral. Likewise, it is noted that two adjacent first range finding points $RFP_1$ and two adjacent second range finding points $RFP_2$ of each sub-areas $OSA_2$ define the slopes of the four sides of the sub-area $OSA_2$. The controller 50 calculates the operated simulated surface OSS of the ground by aggregating the sub-areas $OSA_2$ in three-dimensional space. Like the implementation shown in FIG. 2F, in the implementation shown in FIGS. 3A-3C, the controller 50 may also be able to track a productivity of the operating apparatus 26 resulted from relocating the material from the ground based on a volume between the non-operated simulated surface NSS and the operated simulated surface OSS in three dimensions.

Figure 4A:
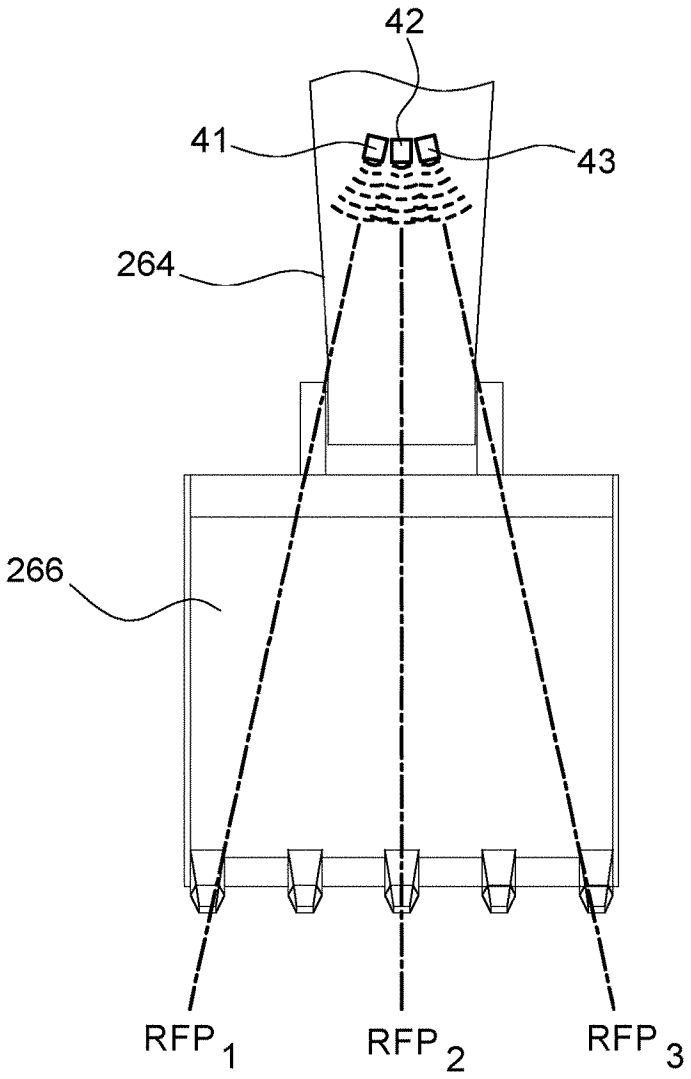
FIG. 4A is a partial rear view illustrating a first sensor, a second sensor, and a third sensor attached on the arm of the work machine in another implementation of the point measuring assembly.
Figure 4B:
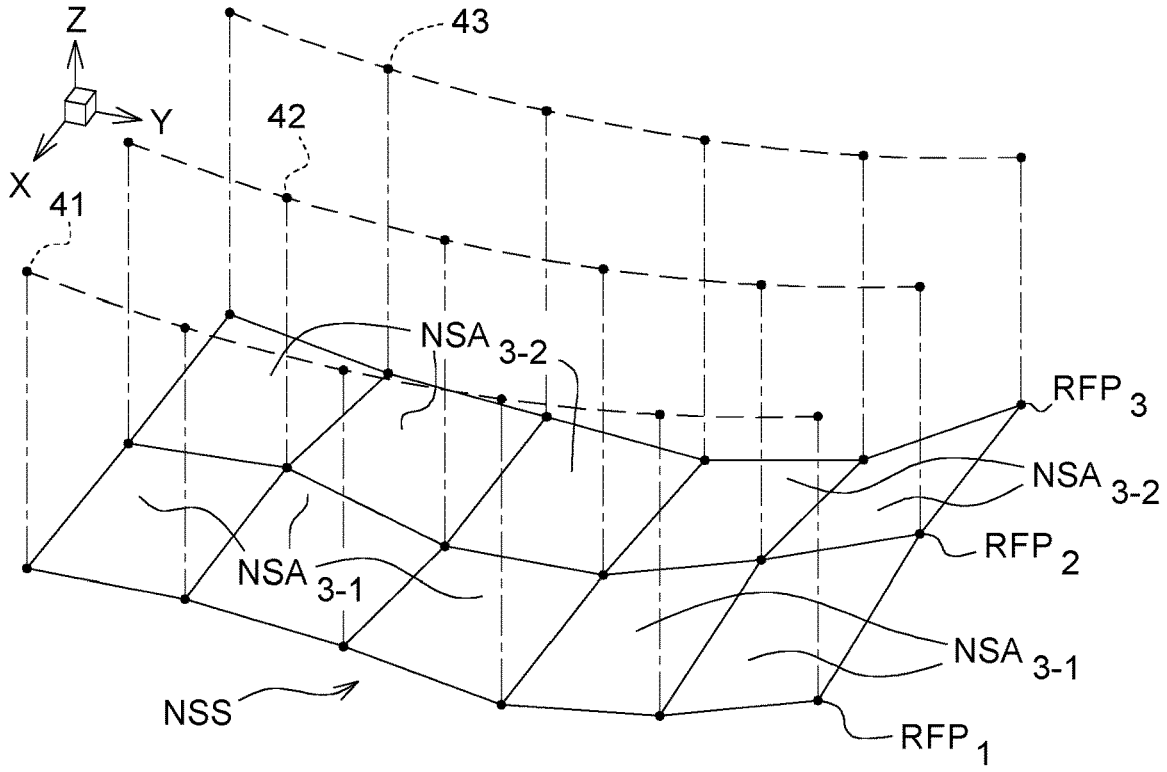
FIG. 4B illustrates the first sensor's trajectory, the second sensor's trajectory, and the third sensor's trajectory with the motion of the operating apparatus and a non-operated simulated surface of the ground having sub-areas before the tool engages the ground.
Figure 4C:
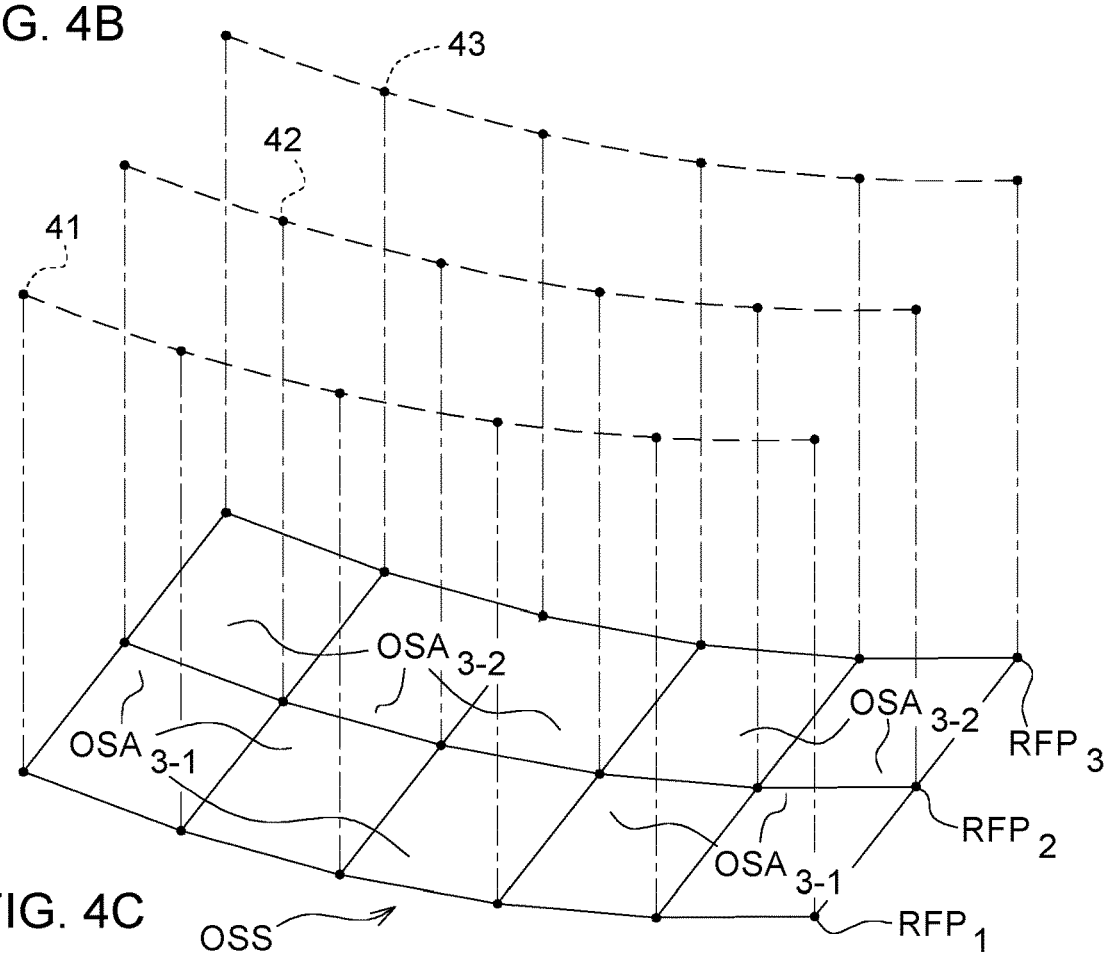
FIG. 4C illustrates the first sensor's trajectory, the second sensor's trajectory, and the third sensor's trajectory with the motion of the operating apparatus and an operated simulated surface of the ground having sub-areas after the tool engages the ground.

Referring to FIGS. 4A-4C, another implementation of the point measuring assembly 40 includes a first sensor 41, a second sensor 42, and a third sensor 43 attached to the inward side of the arm 264 of the operating apparatus 26 and moved together with the arm 264. Referring to FIG. 4B, multiple distances between the first sensor 41 at different locations in its trajectory and respective first range finding points $RFP_1$ designated on the ground by the first sensor 41 are measured before the bucket 266 engages the ground. Multiple distances between the second sensor 42 at different locations in its trajectory and respective second range finding points $RFP_2$ designated on the ground by the second sensor 42 are measured before the bucket 266 engages the ground. Multiple distances between the third sensor 43 at different locations in its trajectory and respective third range finding points $RFP_3$ designated on the ground by the third sensor 43 are measured before the bucket 266 engages the ground. Every two adjacent first range finding points $RFP_1$ and every two adjacent second range finding points $RFP_2$ together define a sub-areas $NSA_{3-1}$, which is quadrilateral. Every two adjacent second range finding points $RFP_2$ and every two adjacent third range finding points $RFP_3$ together define a sub-areas $NSA_{3-2}$, which is quadrilateral. Each sub-area $NSA_{3-1}$ and sub-area $NSA_{3-2}$ shares one side with one another. In this implementation, three sensors (first, second, and third sensor 41, 42, 43) designate range finding points RFP to form two rows of sub-areas (sub-areas $NSA_{3-1}$, $NSA_{3-2}$) corresponding to the trajectories of the first, second, and third sensor 41, 42, and 43. The controller 50 calculates the non-operated simulated surface NSS of the ground by aggregating the sub-areas $NSA_{3-1}$ and $NSA_{3-2}$ in three-dimensional space.

Referring to FIG. 4C, multiple distances between the first sensor 41 at different locations in its trajectory and respective first range finding points $RFP_1$ designated on the ground by the first sensor 41 are measured after the bucket 266 engages the ground. Multiple distances between the second sensor 42 at different locations in the trajectory and respective second range finding points $RFP_2$ designated on the ground by the second sensor 42 are measured after the bucket 266 engages the ground. Multiple distances between the third sensor 43 at different locations in its trajectory and respective third range finding points $RFP_3$ designated on the ground by the third sensor 43 are measured after the bucket 266 engages the ground. Every two adjacent first range finding points $RFP_1$ and every two adjacent second range finding points $RFP_2$ together define a sub-areas $OSA_{3-1}$, which is quadrilateral. Every two adjacent second range finding points $RFP_2$ and every two adjacent third range finding points $RFP_3$ together define a sub-areas $OSA_{3-2}$, which is quadrilateral. Each sub-area $OSA_{3-1}$ and sub-area $OSA_{3-2}$ shares one side with one another. In this implementation, three sensors (first, second, and third sensor 41, 42, 43) designate range finding points RFP to form two rows of sub-areas (sub-areas $OSA_{3-1}$, $OSA_{3-2}$) corresponding to the trajectories of the first, second, and third sensors 41, 42, 43. The controller 50 calculates the operated simulated surface OSS of the ground by aggregating the sub-areas $OSA_{3-1}$ and $OSA_{3-2}$ in three-dimensional space. In the implementation shown in FIGS. 4A-4C, the controller 50 may also be able to track a productivity of the operating apparatus 26 resulted from relocating the material from the ground based on a volume between the non-operated simulated surface NSS and the operated simulated surface OSS in three dimensions.

The number of the sensors of the point measuring assembly 40 described in this application is explanatory. The number of the sensors may be more than three to form more than two rows of sub-areas (NSA and OSA). The more sensors, the more the sub-areas (NSA and OSA), and the non-operated simulated surface NSS and operated simulated surface OSS become smoother. In addition, the frequency of the sensors of the point measuring assembly 40 are varied; the more frequent the sensor(s) of the point measuring assembly 40 measure the distances between the range finding points RFP and the sensor(s), the widths of the sub-areas (NSA and OSA) become more narrower, given that the elements (e.g., arm 264) of the operating apparatus 26 the sensors attached to move at the same speed.

Figure 5:
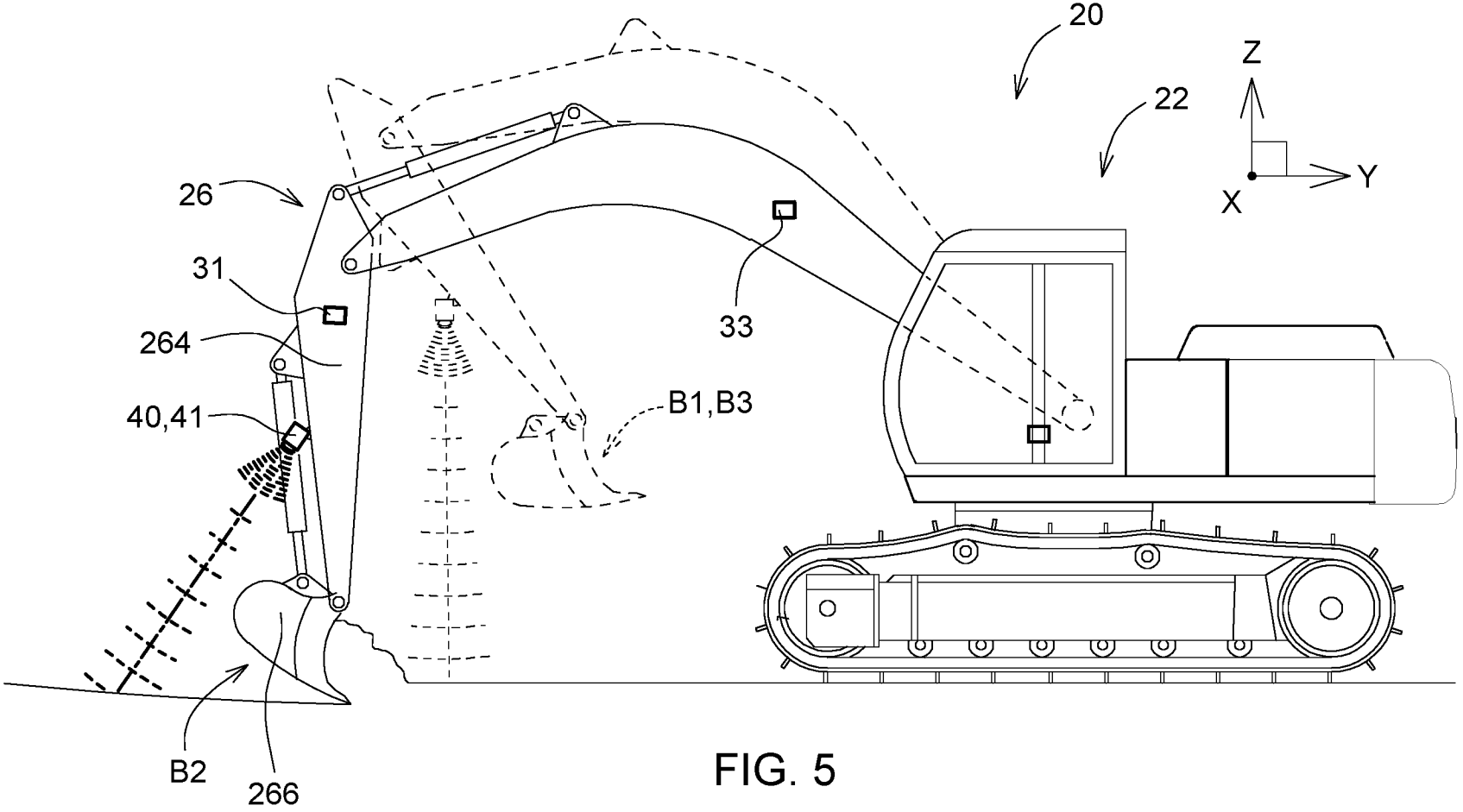
FIG. 5 demonstrates one example of a work machine, which is an excavator in another implementation, having a sensor of the point measuring assembly attached on another side of the arm and measuring the distance between one of range finding point and the sensor.

The location(s) of the sensors of the point measuring assembly 40 described in this application is explanatory. The sensors of the point measuring assembly 40 may be attached to different side of the arm 264 or different elements, such as boom, of the operating apparatus 26. FIG. 5 demonstrates one example of a work machine, which is an excavator in another implementation, having a first sensor 41 of the point measuring assembly 40 attached on outward side of the arm 264. The first sensor 41 scans an away area of the ground, which is separate from the toward area by the arm 264. The first sensor 41 measures the distances between one of range finding points and the first sensor 41. Three explanatory positions B1-B3 of the operating apparatus 26. The position B1 and the position B3 may be the same position. When the operating apparatus 26 moves from the position B1 to position B2, the first sensor 41 can measure the distance between the first sensor 41 and the ground surface before the bucket 266 engages the ground. Multiple distances between the first sensor 41 at different locations in its trajectory and respective first range finding points (not shown) designated on the ground by the first sensor 41 are measured before the bucket 266 engages the ground. The controller 50 calculates the non-operated simulated surface (not shown) of the ground by aggregating the sub-areas (not shown) in three-dimensional space. Then the operating apparatus 26 moves from the position B2 to the position B3 to collect the material from the ground by pivoting the arm 264 and bucket 266. The first sensor 41 had completed distance measurements of the ground during the movement of operating apparatus 26 from the position B2 to the position B3. The controller 50 calculates the operated simulated surface (not shown) of the ground by aggregating the sub-areas (not shown) in three-dimensional space. The controller 50 may also be able to track a productivity of the operating apparatus 26 resulted from relocating the material from the ground based on a volume between the non-operated simulated surface (not shown) and the operated simulated surface (not shown) in three dimensions in the implementation shown in FIG. 5.

Figure 6:
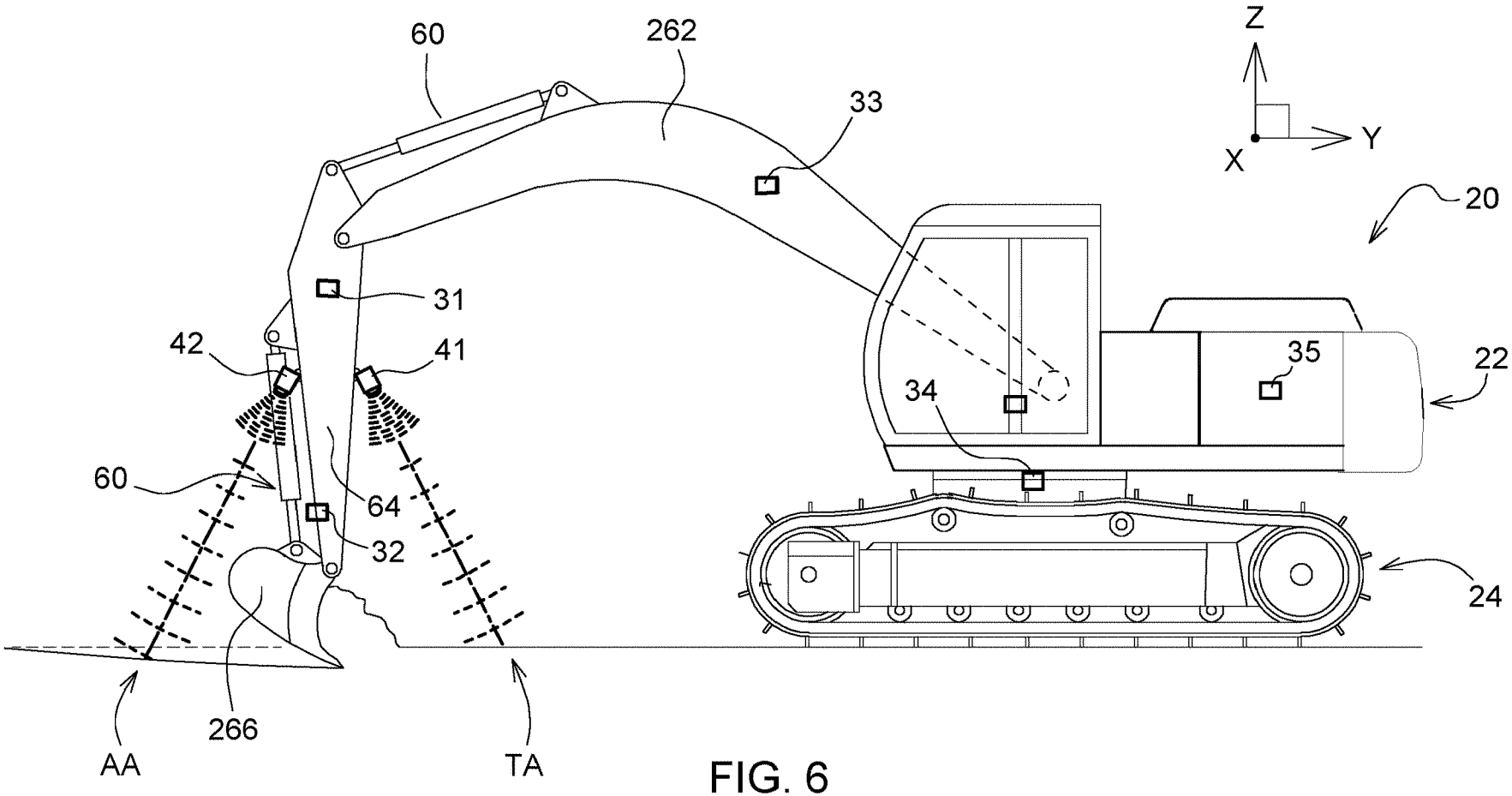
FIG. 6 demonstrates one example of a work machine, which is an excavator in another implementation, having a first sensor measuring the distance of the ground at a toward area and a second sensor measuring the distance of the ground at an away area.

FIG. 6 demonstrates one example of a work machine 20, which is an excavator in another implementation, having a first sensor 41 and a second sensor 42 of the point measuring assembly 40. The first sensor 41 is attached on inward side of the arm 264 and the second sensor 42 is attached on outward side of the arm 264. The first sensor 41 scans a toward area TA of the ground corresponding to the arm 264 swinging toward the body 22 of the work machine 20. The second sensor 42 scans an away area AA of the ground, which is separate from the toward area TA by the arm 264. The away area AA and the toward area TA are changing with the movement of the arm 264. When the arm 264 swings toward the body 22 of the vehicle 20, the away area AA is behind the toward area TA. The first sensor 41 measures the distances between one of range finding points designated by the first sensor 41 on the ground and the first sensor 41. The second sensor 42 measures the distances between one of range finding points designated by the second sensor 42 on the ground and the second sensor 42. The controller 50 calculates a non-operated simulated surface of the ground by aggregating the sub-areas, calculated by the controller 50 based on the distances measured by the first sensor 41 in three-dimensional space. The controller 50 then calculates the operated simulated surface of the ground by aggregating sub-areas, calculated by the controller 50 based on the distances measured by the second sensor 42 in three-dimensional space. The controller 50 may also be able to track a productivity of the operating apparatus 26 resulted from relocating the material from the ground based on a volume between the non-operated simulated surface and the operated simulated surface in three dimensions. It is noted that in this implementation, the controller 50 is configured to track a productivity of a single action of the operating apparatus 26 (e.g., the arm 264) resulted from relocating the material from the ground based on a signal indicative of the distance of the ground at the toward area TA from the first sensor 41 and a signal indicative of the distance of the ground at the away area AA from the second sensor 42.

Figure 7:
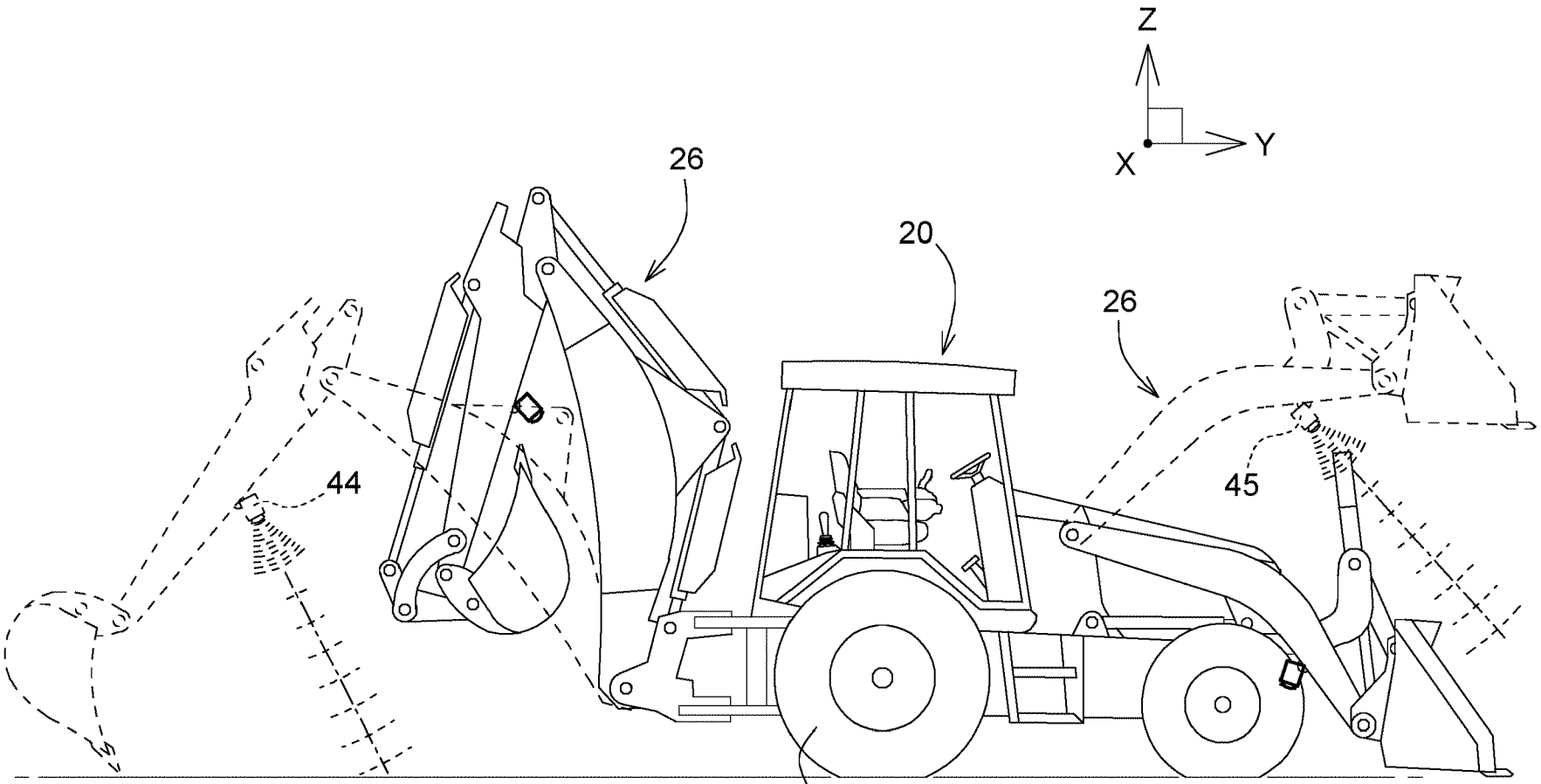
FIG. 7 demonstrates a work machine, which is a backhoe loader, having one sensor in the front operating apparatus and another sensor in the rear operating apparatus.

FIG. 7 demonstrates one example of a work machine 20, which is a backhoe loader. The work machine 20 may have a sensor 44 installed on the backhoe portion and a sensor 45 installed on the front loader portion. The sensor 44 is positioned on the backhoe arm or backhoe boom of the operating apparatus 26 of the work machine 20 and the sensor 45 is positioned on the boom of the operating apparatus 26. When one of the sensor 44, 45 moves together with the operating apparatus 26 during operation, the controller (not shown) may also be able to track a productivity of the operating apparatus 26 (bucket of the backhoe or bucket of the loader) resulted from relocating the material from the ground based on a volume between the non-operated simulated surface and the operated simulated surface in three dimensions.

Figure 8:
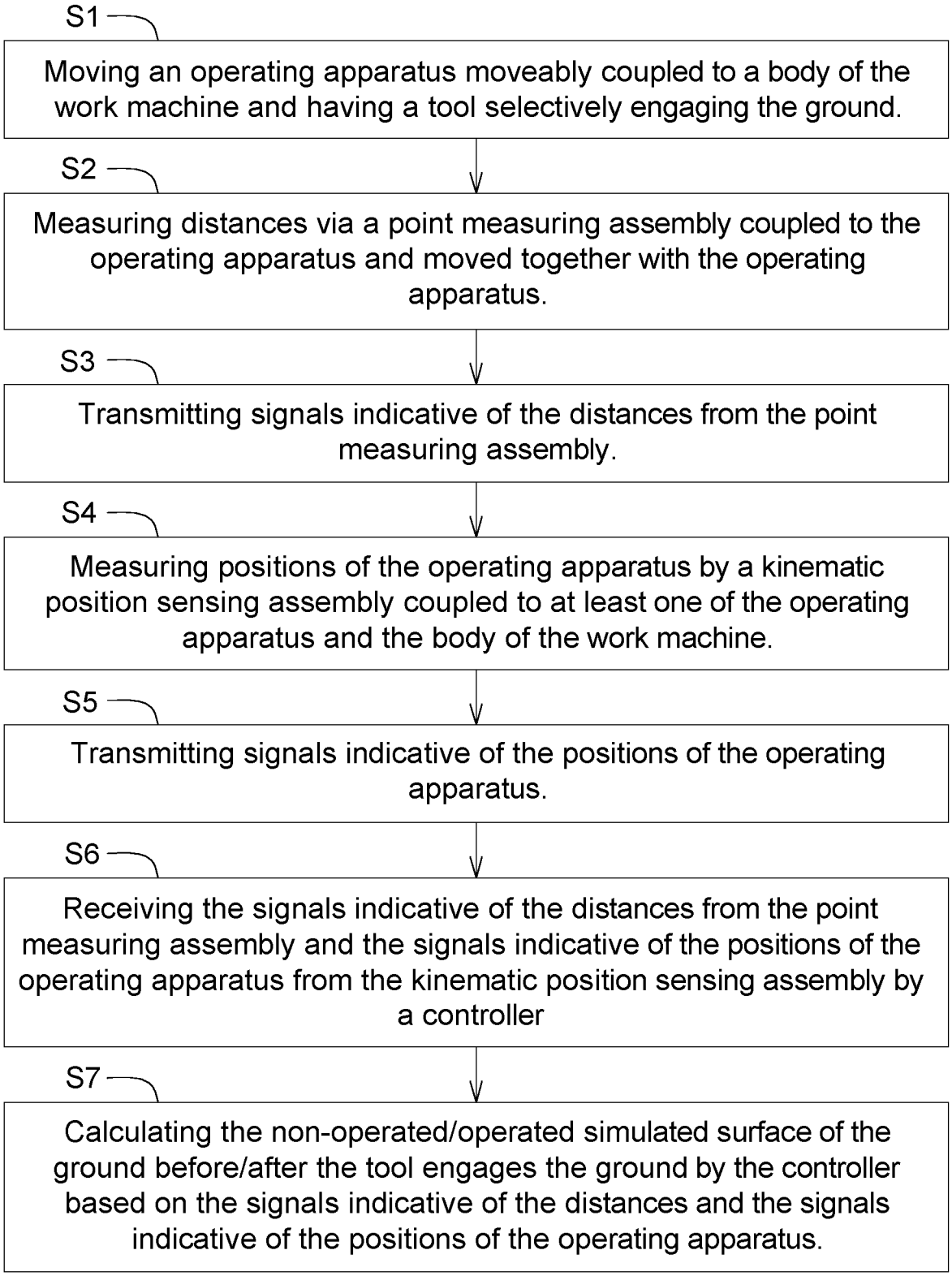
FIG. 8 demonstrates a flow chart depicting the calculation of a non-operated simulated surface or an operated simulated surface.

FIG. 8 illustrates a method of measuring terrain by a work machine configured to operate on the ground, the method comprising:

S1: moving an operating apparatus moveably coupled to a body of the work machine and having a tool selectively engaging or passing over the ground.

S2: measuring distances via a point measuring assembly coupled to the operating apparatus and moved together with the operating apparatus. Each of the distances is between the point measuring assembly and one of range finding points designated on the ground by the point measuring assembly and distributions of the range finding points are in response to the motion of the operating apparatus.

S3: transmitting signals indicative of the distances from the point measuring assembly by the point measuring assembly.

S4: measuring positions of the operating apparatus by a kinematic position sensing assembly coupled to at least one of the operating apparatus and the body of the work machine.

S5: transmitting signals indicative of the positions of the operating apparatus by the kinematic position sensing assembly.

S6: receiving the signals indicative of the distances from the point measuring assembly and the signals indicative of the positions of the operating apparatus from the kinematic position sensing assembly by a controller to calculate at least one simulated surface. The controller may calculate a non-operated simulated surface of the ground, which is not currently engaged by the tool and/or calculate an operated simulated surface of the ground after the tool engages the ground based on the signals indicative of the distances and the signals indicative of the positions of the operating apparatus. It is noted that measuring the distance (S2) and measuring the position of the operating apparatus (S4) may be performed simultaneously, at least at certain period of time.

S7: calculating the non-operated simulated surface of the ground before the tool engages the ground by the controller based on the signals indicative of the distances and the signals indicative of the positions of the operating apparatus or calculating the operated simulated surface of the ground after the tool engages the ground based on the signals indicative of the distances and the signals indicative of the positions of the operating apparatus. The non-operated simulated surface or the operated simulated surface of the ground may be calculated by aggregating sub-areas in three-dimensional space. Each of the sub-areas is defined by at least two of the range finding points designated on the ground by the point measuring assembly.

It is noted that in S1-S7 of the method, either the non-operated simulated surface or operated simulated surface, or both, can be calculated, depending on the condition before the tool engages the ground (or the tool passes over the ground for terrain measurement) or after the tool engages the ground, the number of the sensors in the point measuring assembly, the position of the point measuring assembly, etc. When both non-operated simulated surface and operated simulated surface are calculated, the method of measuring terrain may include tracking a productivity of the operating apparatus resulted to relocate the material from the ground based on a volume between the non-operated simulated surface and the operated simulated surface in three dimensions.

Without in any way limiting the scope, interpretation, or application of the claims appearing below, a technical effect of one or more of the example embodiments disclosed herein is to calculate the non-operated simulated surface or operated simulated surface, or both to measure the terrain of the ground before a work machine operated on the ground or after the work machine operated on the ground. Another technical effect of one or more of the example embodiments disclosed herein is a productivity of the operating apparatus resulted to relocate the material from the ground based on a volume between the non-operated simulated surface and the operated simulated surface. Another technical effect of one or more of the example embodiments disclosed herein is to optimize the future operation or automation control based on the signals indicative of the distances from the point measuring assembly and the signals indicative of the positions of the operating apparatus from the kinematic position sensing assembly.

As used herein, "e.g." is utilized to non-exhaustively list examples and carries the same meaning as alternative illustrative phrases such as "including," "including, but not limited to," and "including without limitation." Unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Terms of degree, such as "generally," "substantially" or "approximately" are understood by those of ordinary skill to refer to reasonable ranges outside of a given value or orientation, for example, general tolerances or positional relationships associated with manufacturing, assembly, and use of the described embodiments.

While the above describes example embodiments of the present disclosure, these descriptions should not be viewed in a limiting sense. Rather, other variations and modifications may be made without departing from the scope and spirit of the present disclosure as defined in the appended claims.

What is claimed is:

1. A work machine configured to operate on the ground, comprising:

a body;

an operating apparatus moveably coupled to the body and having a tool selectively engaging or passing over the ground;

a point measuring assembly coupled to the operating apparatus and moved together with the operating apparatus and configured to measure distances, each of which is between the point measuring assembly and one of range finding points designated on the ground by the point measuring assembly and to transmit signals indicative of the distances, wherein distributions of the range finding points are in response to a motion of the operating apparatus;

a kinematic position sensing assembly coupled to at least one of the operating apparatus and the body of the work machine and configured to measure positions of the operating apparatus and to transmit signals indicative of the positions of the operating apparatus wherein the kinematic position sensing assembly comprises at least one sensor selected from the group consisting one or more of an angle sensor, a position sensor, and a slope sensor configured to measure a slope of a location at which the work machine is located; and a controller configured to receive the signals indicative of the distances from the point measuring assembly and the signals indicative of the positions of the operating apparatus from the kinematic position sensing assembly and to calculate at least one simulated surface of the ground based on the signals indicative of the distances and the signals indicative of the positions of the operating apparatus.

2. The work machine of claim 1, wherein the controller is configured to calculate a non-operated simulated surface of the ground which is not currently engaged by the tool and to calculate an operated simulated surface of the ground after the tool engages the ground.

3. The work machine of claim 1, wherein the controller calculates the simulated surface of the ground by aggregating sub-areas in three-dimensional space, and each of the sub-areas is defined by at least two of the range finding points designated on the ground by the point measuring assembly.

4. The work machine of claim 2, wherein the point measuring assembly includes a first sensor coupled to the operating apparatus and moved together with the operating apparatus and configured to measure distances, each of which is between a first sensor and one of a first range finding points designated on the ground by the first sensor.

5. The work machine of claim 4, wherein the controller calculates the non-operated simulated surface of the ground by aggregating sub-areas in three-dimensional space, and each of the sub-areas is defined by at least two of the first range finding points designated on the ground by the first sensor and a slope of a location at which the work machine is located.

6. The work machine of claim 5, wherein the slope of the location is determined by the controller based on the signals indicative of a position of the work machine from one sensor of the kinematic position sensing assembly installed at the body of the work machine configured to measure the slope relative to a gravity, or data from a database.

7. The work machine of claim 4, wherein the controller calculates the operated simulated surface of the ground after the tool engages the ground by aggregating sub-areas, and each of the sub-areas is defined by at least two of the first range finding points designated on the ground by the first sensor and a slope of an edge of the tool determined by the controller based on signals indicative of the positions of the operating apparatus from the kinematic position sensing assembly.

8. The work machine of claim 7, wherein the tool is a bucket having the edge that shovels the ground.

9. The work machine of claim 4, wherein the point measuring assembly includes a second sensor coupled to the operating apparatus and moved together with the operating apparatus and configured to measure distances, each of which is between a second sensor and one of a second range finding points designated on the ground by the second sensor.

10. The work machine of claim 9, wherein the controller calculates the non-operated simulated surface of the ground or the operated simulated surface of the ground by aggregating sub-areas, and each of the sub-areas is defined by two of the first range finding points designated on the ground by the first sensor and two the second range finding points designated on the ground by the second sensor.

11. The work machine of claim 4, wherein the operating apparatus includes a boom and an arm, and a proximal end of the boom is pivotally coupled to the body and a proximal end of the arm is pivotally coupled to a distal end of the boom and the arm is swingable above the ground, and the first sensor is coupled to the arm.

12. The work machine of claim 11, wherein the point measuring assembly includes a second sensor coupled to the operating apparatus and moved together with the operating apparatus and configured to measure distances, each of the which is between the second sensor and one of second range finding points designated on the ground by the second sensor, and the second sensor is coupled to the arm.

13. The work machine of claim 12, wherein the first sensor and the second sensor measure one of a toward area of the ground corresponding to the arm swinging toward the body and an away area of the ground separate from the toward area with the arm therebetween.

14. The work machine of claim 12, wherein the first sensor measures each distance between the first sensor and one of the first range finding points on the ground at a toward area corresponding to the arm swinging toward the body and the second sensor measures each distance between the second sensor and one of the second range finding points on the ground at an away area separate from the toward area with the arm therebetween.

15. The work machine of claim 14, wherein the controller is configured to track a productivity of a single action of the operating apparatus resulted to relocate the material from the ground based on a signal indicative of the distance from the first sensor and a signal indicative of the distance from the second sensor.

16. The work machine of claim 2, wherein the controller calculates the non-operated simulated surface of the ground and the operated simulated surface of the ground based on the signals indicative of the distances from the point measuring assembly and the signals indicative of the positions of the operating apparatus, and tracks a productivity of the operating apparatus resulted from relocating the material from the ground based on a volume between the non-operated simulated surface and the operated simulated surface in three dimensions.

17. The work machine of claim 1, wherein the work machine is one of an excavator, a backhoe loader, and a dozer.

18. A method of measuring terrain by a work machine configured to operate on the ground, the method comprising:

moving an operating apparatus moveably coupled to a body of the work machine and having a tool selectively engaging or passing over the ground;

measuring distances via a point measuring assembly coupled to the operating apparatus and moved together with the operating apparatus, wherein each of the distance is between the point measuring assembly and one of range finding points designated on the ground by the point measuring assembly, and distributions of the range finding points are in response to a motion of the operating apparatus;

transmitting signals indicative of the distances from the point measuring assembly;

measuring positions of the operating apparatus by a kinematic position sensing assembly coupled to at least one of the operating apparatus and the body of the work machine;

transmitting signals indicative of the positions of the operating apparatus;

receiving the signals indicative of the distances from the point measuring assembly and the signals indicative of the positions of the operating apparatus from the kinematic position sensing assembly by a controller to calculate at least one simulated surface of the ground based on the signals indicative of the distances and the signals indicative of the positions of the operating apparatus wherein the simulated surface is calculated by aggregating sub-areas in three-dimensional space defined by the range finding points, and productivity tracking is based on the volume between a non-operated and an operated simulated surfaces of the ground.

19. The method of claim 18, wherein calculating the at least one simulated surface includes calculating a non-operated simulated surface of the ground which is not currently engaged by the tool and an operated simulated surface of the ground after the tool engages the ground.

20. The method of claim 18, wherein each of the sub-areas is defined by at least two of the range finding points designated on the ground by the point measuring assembly.

21. The method of claim 19, comprising:

calculating the non-operated simulated surface of the ground by the controller based on the signals indicative of the distances from the point measuring assembly and the signals indicative of the positions of the operating apparatus;

calculating the operated simulated surface of the ground after the tool engages the ground based on the signals indicative of the distances from the point measuring assembly and the signals indicative of the positions of the operating apparatus; and tracking a productivity of the operating apparatus resulted to relocate the material from the ground based on a volume between the non-operated simulated surface and the operated simulated surface in three dimensions.

* * * * *